US006631892B1

(12) United States Patent
Erickson

(10) Patent No.: US 6,631,892 B1
(45) Date of Patent: Oct. 14, 2003

(54) TRAY CONTACTOR WITH SAME DIRECTION LIQUID FLOW

(76) Inventor: Donald C. Erickson, 1704 S. Harbor La., Annapolis, MD (US) 21401

( * ) Notice: Subject to any disclaimer, the term of this patent is extended or adjusted under 35 U.S.C. 154(b) by 0 days.

(21) Appl. No.: 09/763,513

(22) PCT Filed: Aug. 25, 1998

(86) PCT No.: PCT/US98/17339

§ 371 (c)(1),
(2), (4) Date: Feb. 23, 2001

(87) PCT Pub. No.: WO00/10696

PCT Pub. Date: Mar. 2, 2000

(51) Int. Cl.[7] ..... B01F 3/04

(52) U.S. Cl. ..... 261/114.1; 261/114.5; 261/148; 261/155

(58) Field of Search ..... 261/114.1, 114.5, 261/128, 148, 149, 152, 155

(56) References Cited

U.S. PATENT DOCUMENTS

| | | | | | |
|---|---|---|---|---|---|
| 385,504 | A | | 7/1888 | Colwell | |
| 1,567,458 | A | * | 12/1925 | Newton | 261/148 |
| 2,330,326 | A | | 9/1943 | Atkeson | |
| 2,492,932 | A | | 12/1949 | Fausek et al. | |
| 2,693,350 | A | | 11/1954 | Ragatz | |
| 2,713,478 | A | * | 7/1955 | Ragatz | |
| 2,963,872 | A | * | 12/1960 | Latimer | |
| 3,162,700 | A | * | 12/1964 | Irons | 261/114.1 |
| 3,172,922 | A | * | 3/1965 | Kehse | 261/114.1 |
| 3,410,540 | A | | 11/1968 | Bruckert | |
| 3,445,343 | A | * | 5/1969 | Popov | 261/148 |
| 3,509,203 | A | * | 4/1970 | Michaelis et al. | 261/114.1 |
| 3,642,452 | A | | 2/1972 | Roget et al. | |
| 4,009,230 | A | * | 2/1977 | Smorenburg | 261/148 |
| 4,556,522 | A | * | 12/1985 | Wilson | 261/114.1 |
| 5,466,419 | A | * | 11/1995 | Yount et al. | 261/114.5 |
| 5,766,519 | A | | 6/1998 | Erickson | |
| 5,798,086 | A | * | 8/1998 | Erickson | 261/114.1 |

* cited by examiner

*Primary Examiner*—C. Scott Bushey

(57) ABSTRACT

A vapor-liquid contactor includes a plurality of vertically stacked trays (151) within a containment column, the central downcomer (152) provides a liquid supply and removal area at the same location on each tray (151), so that the horizontal liquid flow pattern is the same on each tray (151). The contactor also includes vertical partitions (154) positioned transverse to the liquid flow within the vapor space of each tray (151) to minimize vapor mixing. The trays (151) may also include an indirect heat exchanger in the form of tubing arrays (208).

8 Claims, 9 Drawing Sheets

FIG. 3
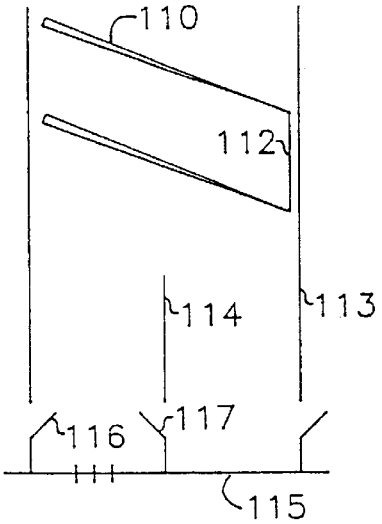
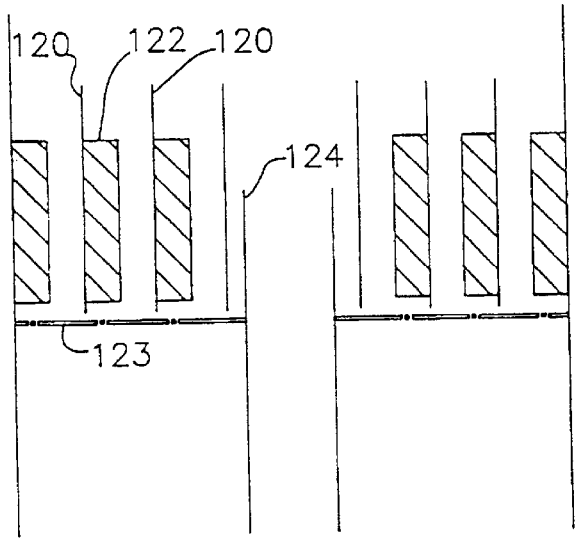
FIG. 4
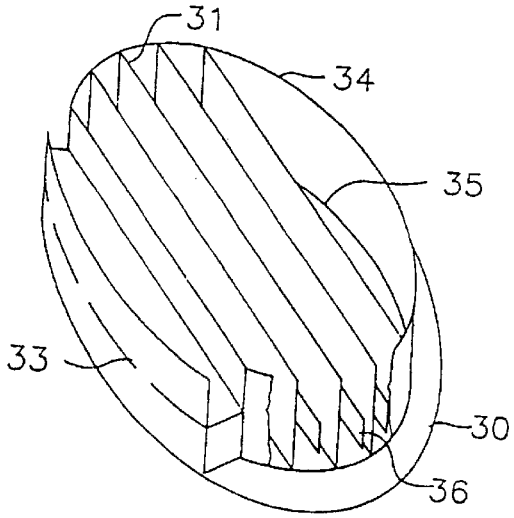
FIG. 5

TRAY CONTACTOR WITH SAME DIRECTION LIQUID FLOW

TECHNICAL FIELD

The invention is directed toward multistage vertical tray-type vapor-liquid contactors which find use in a variety of equipment and industrial processes such as fractional distillation, absorption, stripping, mixing, and partial condensation (dephlegmation).

BACKGROUND

Multicomponent fluid vapor-liquid contactors of the tray or plate type have several known limitations which result in large diameter, large height, high cost, high-energy demand, and high-pressure drop. The diameter is determined by the flooding limitation, i.e., the loading. The overall height is determined by the tray efficiency and height of a tray. Tray height is related to the point efficiency and froth height, which are interrelated, and are controlled by vapor injector geometry and weir height. Tray pressure drop is comprised of the vapor injector drop plus the tray liquid head. The energy demand is determined by the reboil requirement for above-ambient contactors, and by the reflux requirement for below-ambient contactors. Incorporating heat exchange in the column (i.e., diabatic distillation) is known to be one method of reducing the external reboil or reflux demand. Examples of diabatic distillation are disclosed in U.S. Pat. Nos. 385,504; 2,330,326; 2,492,932; 2,963,872; and 3,642,452. The limitations enumerated above are interrelated to some extent, with various tradeoffs possible. For example, the energy requirement can be reduced somewhat by adding trays and hence increasing column height, or vice versa. Larger diameter can reduce tray height and overall height, etc.

Vapor-liquid contactors are used in distillation columns, rectifiers, strippers, absorbers, mixing (reverse distillation) columns, absorption cycle apparatus, bioreactors, reactive distillation columns, and similar devices.

Various approaches to overcoming the above limitations have been disclosed in the prior art. Higher point efficiencies have been achieved in spinning cone contactors, and by imparting horizontal velocity to part of the vapor. Higher vapor loadings have been achieved using locally co-current trays plus separators which route the liquid to a twice-lower tray (U.S. Pat. No. 4,361,469). Other approaches to achieving local cocurrency are disclosed in U.S. Pat. Nos. 2,693,350; 3,642;542; 5,766,519; and 5,798,086. Conventional trays have a crosscurrent contact pattern, and cannot be increased to the higher loading characteristic of cocurrency without flooding. Higher liquid loadings have been achieved by multiple downcomers (U.S. Pat. No. 3,410,540). Reduced energy demand has been achieved in the diabatic distillation disclosures. One problem with the prior art approaches to overcoming the various limitations listed above is that they usually address only a single limitation, with modifications which may make it more difficult to overcome the other limitations.

It is known that conventional crosscurrent trays approach a tray efficiency limit of 150% of the point efficiency when the horizontal liquid flow direction is reversed on each successive tray and the vapor is unmixed; 167% with fully mixed vapor; and 200% when the liquid direction is the same on each tray and the vapor is unmixed. This boost in efficiency is owing to the extra boost provided by effectively having multiple horizontal stages on each vertical tray, i.e., due to concentration gradients across the tray.

What is needed, and among the objects of this invention, are apparatus and process for vapor-liquid contact which achieve the thermodynamic advantage of globally counter-current multistage contact, the tray efficiency (reduced column height) advantage of tray crosscurrent contact, and the point efficiency and loading (reduced column diameter) advantages of locally co-current liquid recirculated contact. Preferably, the contactor would achieve further increase in tray efficiency and corresponding decrease in tray count and column height by same-direction horizontal liquid flow on each tray coupled with structure to prevent vapor mixing. Preferably, the contactor would also achieve lower energy demand. Most preferably, all of those desirable objects would be achieved simultaneously by compatible and synergistic measures.

DISCLOSURE OF INVENTION

The above and additional useful advantages are obtained in apparatus and corresponding process for multistage multicomponent fluid mass exchange wherein at least one type of same-direction liquid flow is present on all the trays of the contact section: horizontal same-direction flow, and/or vertical same-direction. More particularly, in the latter case, the contactor is comprised of:

A vapor-liquid contactor comprised of:

a. a multiplicity of vertically stacked trays within a containment;

b. a multiplicity of channel weirs on each tray, each channel weir defining a locally co-current vapor-liquid upflow zone on one side of the channel weir, and a liquid down flow zone on the other side; said channel weirs having a liquid passage opening at or near the bottom for transport of liquid from the downflow zone to the co-current upflow zone;

c. a multiplicity of vapor passages through said trays at the bottom of said co-current upflow zones;

d. a level control liquid weir on each tray, which is at a lower height than said channel weirs;

e. a passage for transport of liquid spillover from said liquid weir to the next lower tray;

f. a vapor supply below said stack of trays; and g. a liquid supply and vapor withdrawal above said stack of trays In contrast to conventional trays which have a turbulent froth region wherein the liquid flows in all directions, the above disclosure results in liquid flowing vertically the same direction (downward) in all the downcomers, and upward in all the risers (upflow zones).

More intensified vapor-liquid contact, and hence higher point efficiency or lower froth height, can be obtained by placing enhanced contact media in the co-current upflow channels. The required amount of media is relatively very small, since much of the tray volume is empty space, yet all the fluid traverses the upflow channels, which are highly loaded. The media can also be catalytically active, to support chemically reactive distillation. Thus maximum utilization of a small amount of catalyst is achieved.

The tray loading can be further increased, and/or tray height further decreased, by providing apparatus for vapor-liquid separation above the channel weirs. Thus the vapor-liquid separation is accelerated and made more effective compared to simply relying on open-space separation. It is important that the liquid drainage from the separator be directed to the downflow zone (downcomer channels), as otherwise it can be re-entrained in the upflowing vapor.

Each tray is fitted with a level control liquid weir, much like conventional trays, and the weir overflow is routed to the next lower tray. It is frequently preferred to route the overflow liquid to the same comparative location on each succeeding or adjoining tray—this allows the tray efficiency to approach 200% of the point efficiency provided the vapor is prevented from mixing, e.g., by partitions. When the horizontal liquid flow direction is opposite on adjacent trays, then the tray efficiency only approaches 150% of the point efficiency for unmixed vapor, or 167% for fully mixed vapor.

This gives rise to the other case of same direction liquid flow—horizontal. In that case, the contactor is comprised of:

a. a multiplicity of vertically stacked trays within a containment;

b. a liquid supply area and liquid removal area to and from each tray, wherein each supply and removal area is at the same relative location on each tray, whereby the net horizontal liquid flow on each tray is in the same directional pattern; and c. a multiplicity of partitions in the vapor space of each tray which are transverse to the flow direction of said liquid, and thereby minimize vapor mixing.

The compartmentalization reduces the horizontal mixing of both the liquid and the vapor, resulting in larger concentration gradients and hence higher tray efficiencies for a given point efficiency (provided the horizontal liquid flow is the same direction on each corresponding section of each tray). For very large diameter trays, the partitions only need to be in the vapor space; for smaller trays, they should extend into the liquid space as well to reduce liquid mixing. When they do, suitable openings or clearance for liquid transport are provided.

In order to ensure good liquid renewal on all active parts of the tray, the liquid transport openings in the respective compartment partitions can be staggered so as to ensure a tortuous liquid flowpath across the entire tray. The relative amount of liquid recirculation within a compartment relative to the net liquid transport through a compartment can be controlled by varying the area of the liquid transport openings at the bottom of the compartment partitions relative to the area of the liquid recirculation openings at the bottom of the channel dividers, and also by varying-the weir overflow area.

The trays may be circular, rectangular, or other known shapes. Diameters in the range of 50 to 10,000 mm are contemplated. The vapor passages through each tray may be orifices, slots, tubes, valves, bubble caps, and the like. Hole diameters in the range of 0.5 mm to 20 mm are contemplated, and even larger for valve or bubble cap openings. Tray heights between 50 and 1000 mm are contemplated. Spacing between compartment partitions and channel dividers in the range of 5 to 500 mm is contemplated. Flooding limits are anticipated to be between 10% and 300% higher than for conventional sieve trays, dependent on vapor-liquid separator efficiency.

Prior art multistage tray contactors can be divided into three categories dependent upon where the liquid is introduced to each tray and where it is removed. The commonest is entry at one peripheral location and exit from the opposite periphery, with horizontal opposite-direction liquid flow across each tray. When this type of tray becomes large, a liquid concentration gradient forms across the tray. Unfortunately, the same size parameter which causes the liquid gradient also causes a vapor concentration gradient, e.g., prevents full mixing of the vapor, thus limiting the tray efficiency improvement factor.

The "peripheral-to-peripheral" category can also be configured for same-direction horizontal liquid flow. FIGS. 4 and 5 of U.S. Pat. No. 2,963,872 disclose one example of this, and FIG. 5 herein discloses another example. However, the full benefit of same-direction horizontal liquid flow is not obtained unless vapor mixing is prevented. Hence, this invention extends to adding transverse partitions at least in the vapor space to any of the same-direction horizontal liquid flow configurations.

The second category of liquid entry to and exit from the tray is center-to-center. U.S. Pat. No. 4,032,410 discloses one center-to-center configuration, with opposite direction liquid horizontal flow on each adjoining tray. FIGS. 7, 13, and 22 herein disclose new approaches to achieving the center-to-center flow configuration. They have the advantage of much larger weir length, larger downcomer size, and greater downcomer height, thus accommodating higher liquid loadings. Also, very importantly, a simple construction is disclosed which achieves horizontal same-direction liquid flow, including a concentration gradient, in the center-to-center configuration.

The third category is mixed—either center-to-periphery or periphery-to center. Examples of this are found in "Multiple Downcomer" trays, in the Oldershaw configuration, and in FIG. 1 herein.

The new center-to-center configurations disclosed herein have another advantage in addition to preserving reasonable weir lengths and providing large downcomer area-and height without using as much of the column cross section as conventional designs. The additional advantage is a clear periphery or circumference. This facilitates incorporating heat exchange into the column so as to reduce the energy requirement. One approach is to exchange heat with fluid in an annular space outside the tray wall. This is effective, since the entire wall circumference is wetted with two-phase froth. However, the surface-to-volume effect makes this less effective at larger diameters. Another approach is to mount heat exchange tubing inside the column on each tray, suspended in the froth. This can be done with simple vertical-axis coils on each tray. However, that doesn't take advantage of the temperature gradient on each tray. In order to do that, a horizontal-axis conforming array coil is used, as illustrated in FIG. 13. Two or more coils of approximately mirror image are used on each tray, to accommodate the liquid which flows in two mirror image 180° segments around each tray, thereby providing fully counter-current heat exchange. For other tray designs wherein there is only a single liquid path, e.g., a "ring" tray, there need only be a single conforming coil for the entire periphery. There again, the transverse partitions which prevent vapor mixing are a key addition. The transverse partitions also provide convenient mounting and support points for the coils, whatever type of coil is used.

In summary, all three of the major tray column limitations—column height, column diameter, and column energy demand—are improved by a single new configuration with mutually compatible and synergistic features: center-to-center liquid transport in the same horizontal direction with partitions to prevent vapor mixing; conforming heat exchange coils which are supported by the partitions; and channel weirs plus down comer zones for same-direction vertical liquid flow. Furthermore, for situations wherein all three limitations are not significant, appropriate sub-combinations of the newly disclosed configuration are adaptable to improve any single limitation or any combination of two of the three. For example, when an existing column is to be retrofitted, if a higher capacity is the only improvement called for, then only liquid recirculation (same-direction vertical flow) may be provided. If a sharper separation (purer products) is the only needed improvement, then only same-direction horizontal flow plus partitions may be called for. And if reduced energy demand is the only needed improvement, then center-to-center feed plus heat exchange coil may be the only improvement used.

BRIEF DESCRIPTION OF THE DRAWINGS

FIG. 3 is a detail of a single compartment showing riser, downcomer, weir, vapor injectors, and separator.

FIG. 4 illustrates the embodiment with contact media or catalyst in the riser channels.

FIG. 5 illustrates one new method of achieving periphery-to-periphery same-direction horizontal flow, including vapor partitions.

FIGS. 14, 15, and 16 are the constituent parts of the FIG. 13 tray downcomer, and.

BEST MODE FOR CARRYING OUT THE INVENTION

Figure 1:
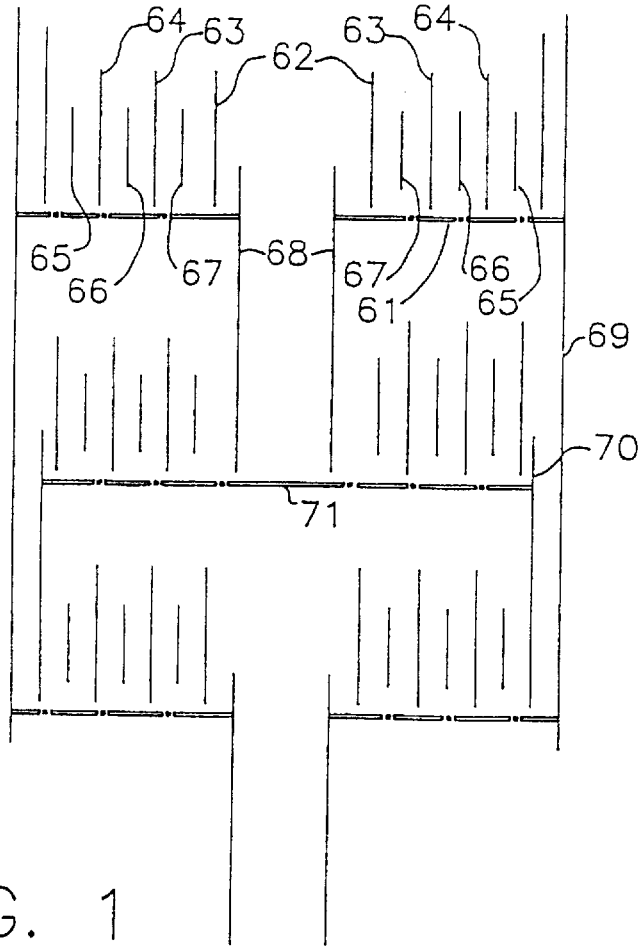
FIG. 1 is a cutaway view of a section of vapor-liquid contactor with same-direction vertical liquid flow and opposite-direction horizontal liquid flow.
Figure 2:
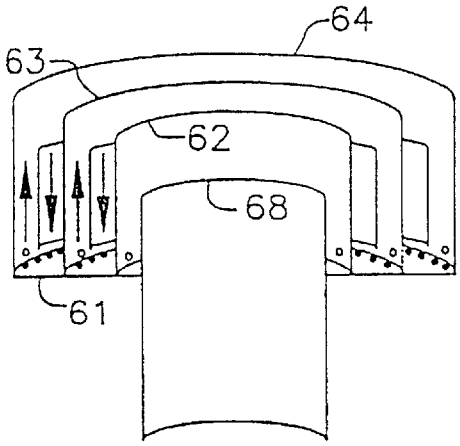
FIG. 2 is a perspective cutaway view illustrating the flow directions.

FIG. 1 illustrates vertically stacked trays (61, 71) within containment 69. The liquid flows horizontally in opposite radial directions on each successive tray, owing to the alternating sequence of central downcomer/tray weir 68 and peripheral downcomer/tray weir 70. Each tray is adapted for liquid recirculation, i.e., for same-direction vertical flow, by means of cylindrical compartment partitions 62, 63, and 64, plus channel weirs 65, 66, and 67. Within each compartment, vapor injectors (e.g. perforations) are located under the riser channels but not under the downcomer channels. FIG. 2 illustrates the liquid flow directions on tray 61. Note that the compartment partitions do not extend all the way to the next higher tray. This allows vapor mixing, which is advantageous for opposite-direction flow. However, that is counteracted by the reduced froth height and resulting reduced point efficiency, so at times the vapor partitions will extend all the way up even with opposite-direction flow.

FIG. 3 is a detail of one single compartment, with compartment partition 113 and channel weir 114, above tray 115. Liquid flow through the partition and weir is accommodated by louvers 116 and 117 respectively. FIG. 3 shows the optional inclusion of vapor-liquid separator segments 110 with drainage path 112 into the downcomer channel of the compartment—this separator enables higher vapor loadings without flooding. FIG. 4 illustrates another optional enhancement of the liquid recirculation feature incorporating contact media 122 in the riser channels above tray 123 in the compartments formed by compartment partitions 120. Tray weir 124 is at a lower height than the channel weirs. The media can include a catalytic agent.

FIG. 5 illustrates a tray having both same-direction vertical flow (liquid recirculation) and same-direction horizontal flow. Liquid from the tray above falls onto shelf 33, and then flows bi-directionally in an annular space around the periphery of tray 30 which is defined by shroud 34. It enters the contact zone of tray 30 through opening 35, flows across the tray, and then down to the next tray. This is "periphery-to-periphery" same-direction horizontal flow. Vapor mixing is impeded by partitions 31 positioned transverse to the liquid flow direction. The vapor partitions extend up to the next higher tray. Channel weirs 36, plus appropriately placed tray vapor injectors, cause the liquid recirculation on each tray.

Figure 6:
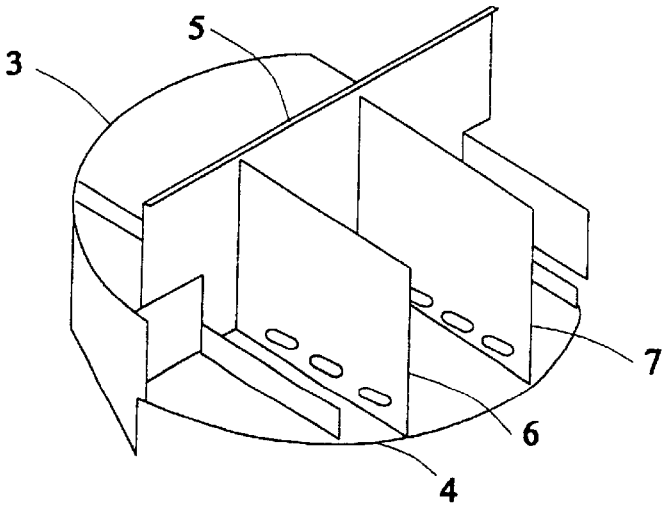
FIG. 6 illustrates a traditional method of achieving same-direction horizontal flow, but with vapor partitions added.

FIG. 6 is another example of periphery-to-periphery same-direction horizontal flow, of the type disclosed in U.S. Pat. No. 2,963,872. The tray is bifurcated into two halves 3, 4, at staggered heights, by center barrier 5. Liquid flows in opposite direction on each half, then drops half a tray height to the other side. A downcomer is required at each end, and the downcomer height is only half the total tray spacing. The novel feature is the addition of transverse vapor partitions 6 and 7 which reduce vapor mixing, and hence increase tray efficiency.

Figure 7:
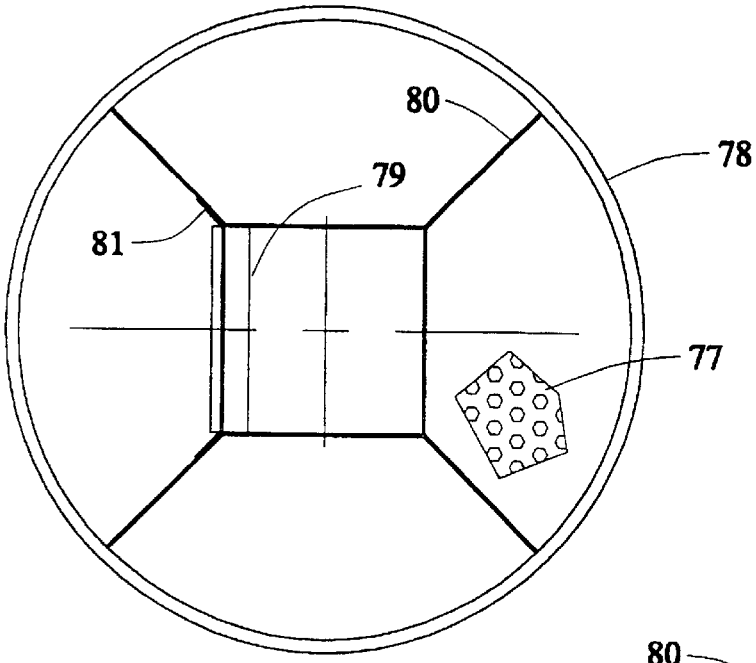
FIGS. 7 and 8 are cutaway views of a new method of center-to-center same-direction horizontal liquid flow, including vapor partitions.
Figure 8:
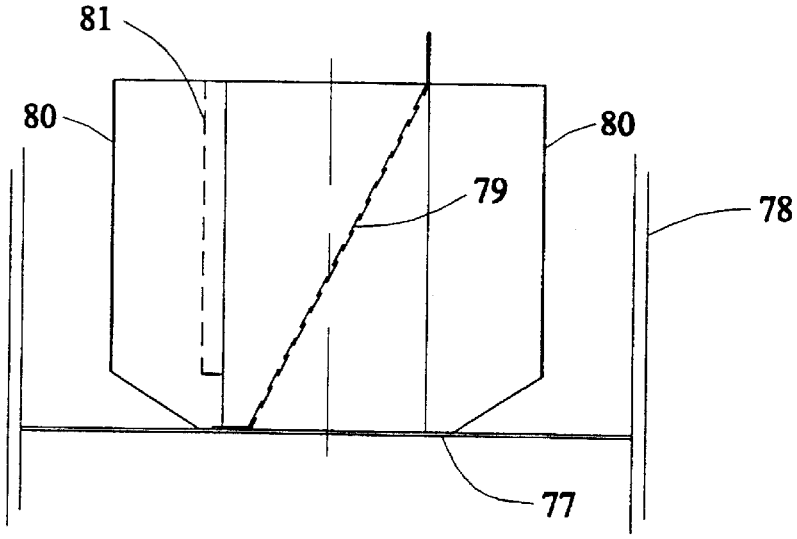

In the effort to preserve the benefit of same-direction horizontal liquid flow plus partitions, while avoiding the detriments of reduced downcomer height and need for double downcomers, new same-direction horizontal flow. configurations have been conceived. FIGS. 7 and 8 are top and side views respectively of one such configuration. Tray 77 within containment 78 has a centrally located downcomer comprised of a diagonal member 79, and partitions 80 (two) and 81 (one). The top tab of diagonal member 79 is the tray weir for the tray above.

Figure 9:
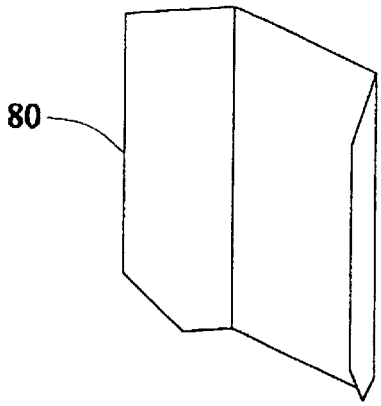
FIGS. 9 and 10 are perspective drawings of constituent parts of FIG. 7.
Figure 10:
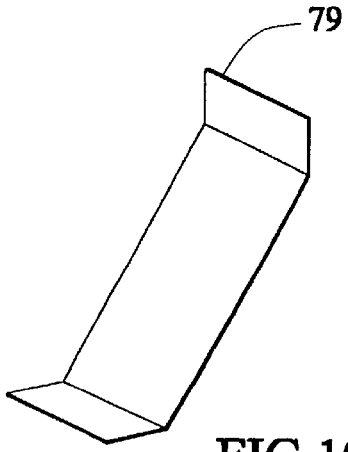

FIGS. 9 and 10 are perspective views of components 80 and 79 respectively. Liquid exits from the right hand side of each tray into the central downcomer and flows diagonally down to a point 180° opposite (left-hand side), and then flows bi-directionally around the periphery through the contact zone to the next liquid exit. Vapor mixing is blocked by the partitions 80.

Figure 11:
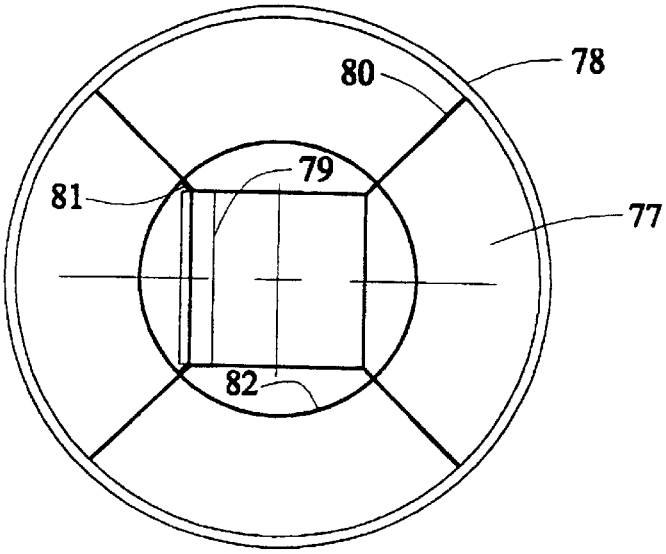
FIG. 11 adds channel weirs to FIG. 7 so as to also have same-direction vertical flow.

FIG. 11 illustrates the incorporation of liquid recirculation into the FIG. 7 configuration, by addition of a cylindrical channel weir 82. Assuming that tray 77 is a sieve tray design, then the perforations would only be outside weir 82, and not between weir 82 and partitions/downcomer walls 80 and 81

Figure 12:
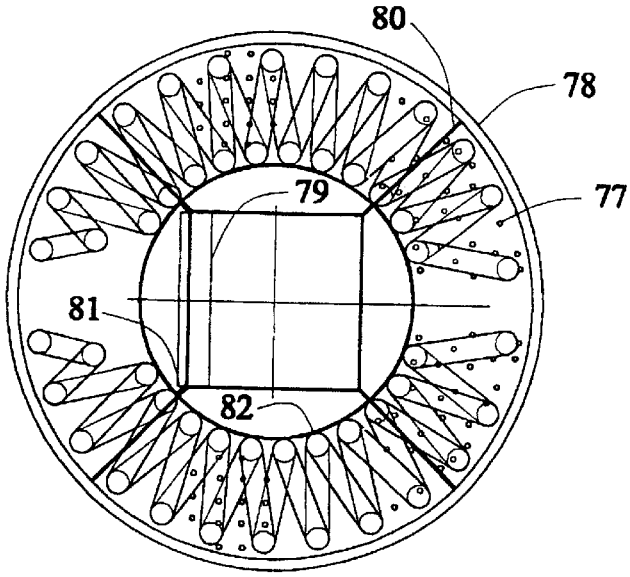
FIG. 12 adds heat exchange to the FIG. 11 embodiment, in the form of a pair of conforming array coils.

FIG. 12 illustrates the incorporation of heat exchange into the FIG. 7 configuration. The clear peripheral contact zone facilitates adding a coiled tubular heat exchanger on each tray. In order to take advantage of the increasing temperature gradient of the flowing liquid, the tubular coil can be fashioned into a conformal array. This makes efficient use of the available space, and provides good heat transfer since the coil is submerged in the turbulent froth region. The heat exchange coil on each tray connects at the respective ends to the coils on the tray above and below; the connector tubing can be routed through the downcomer, or alternatively directly through a suitable cutout of the tray.

Since this configuration has bidirectional horizontal flow of liquid through the contact zone, the conformal array should be provided in two mirror image halves in order to achieve full counter-currency.

Figure 13:
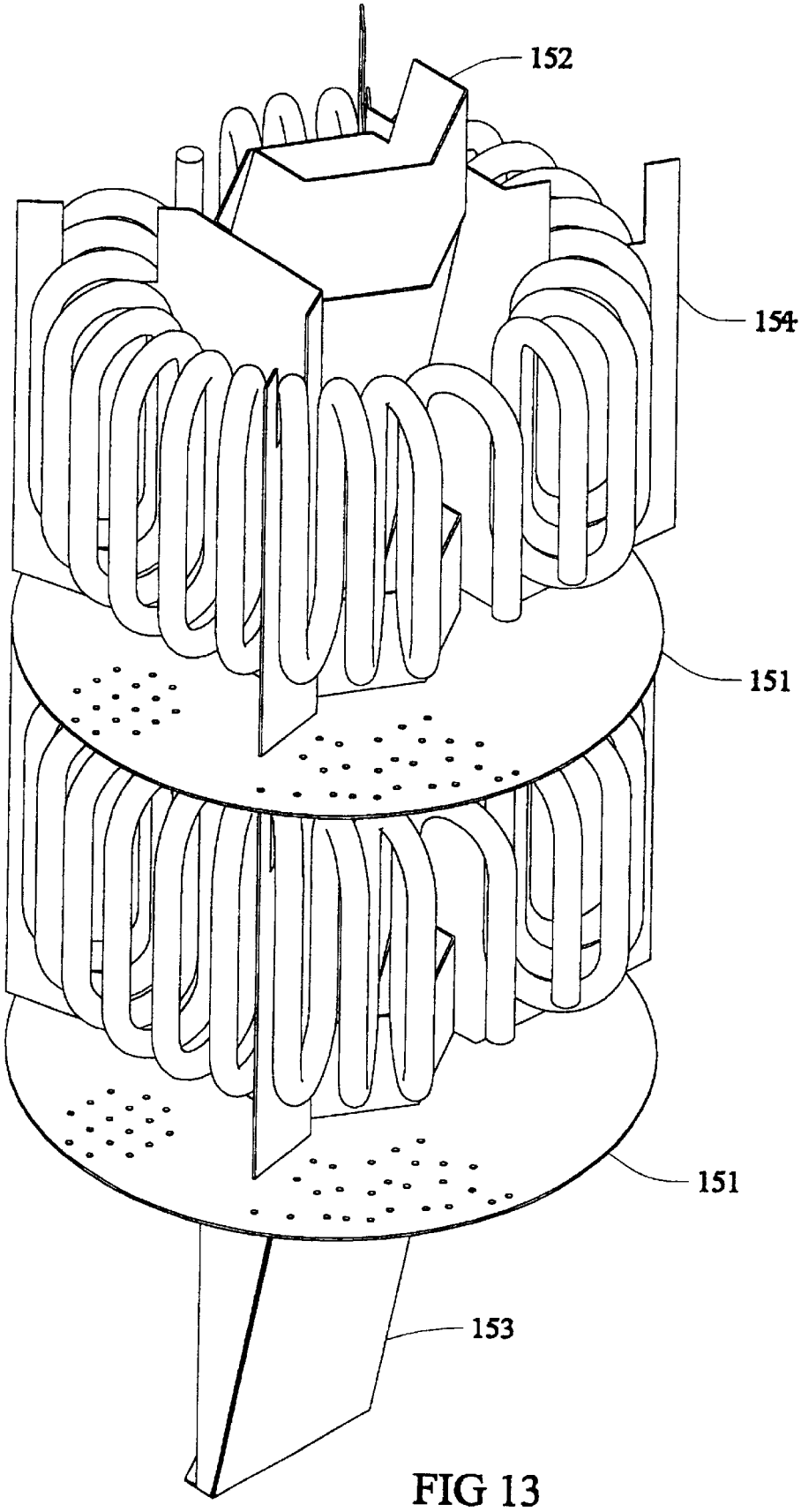
FIG. 13 is a perspective view of two trays having center-to-center same-direction horizontal liquid feed, a hexagonal downcomer between trays and conforming array heat exchange coils.
Figure 17:
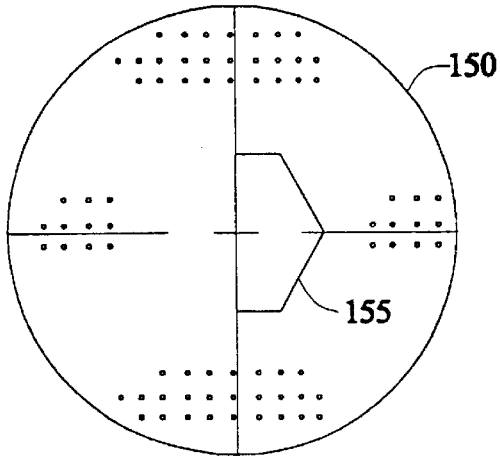
FIG. 17 is the tray.
Figure 16:
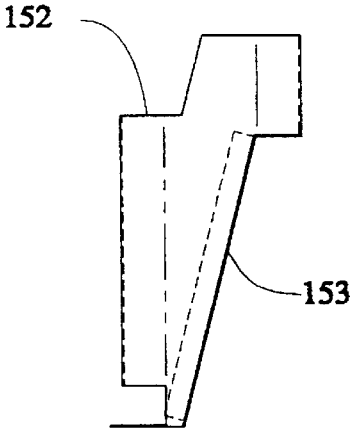
Figure 15:
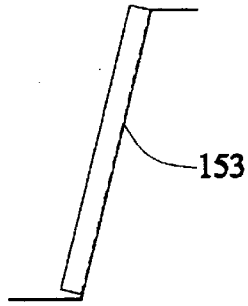
Figure 14:
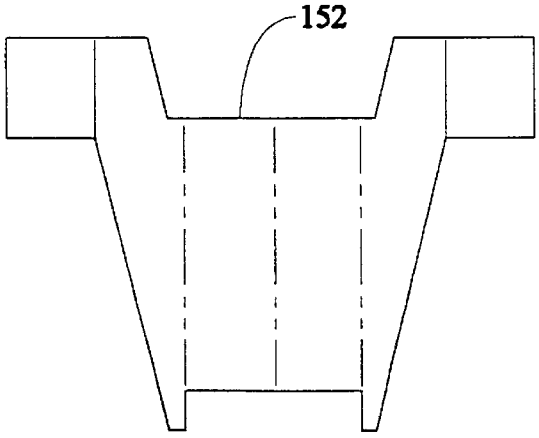

FIG. 13 is a perspective view of another central-downcomer same-direction horizontal liquid flow configuration. The two sieve trays 150, 151 have between 4 and 12% open area in the peripheral contact zone. Hexagonal central downcomer is comprised of vertical member 152, diagonal member 153, and partitions 154. The top portion of member 152 is the tray weir for the above tray. The central section of partitions 154 form part of the downcomer, and the wing sections both provide support points for the conforming array and also serve as vapor block partitions. FIGS. 14 and 15 are details of components 152 (before bending) and 153, and FIG. 16 shows them assembled. FIG. 17 illustrates sieve tray 150, with cutout 155 which accommodates the tray downcomer.

Figure 19:
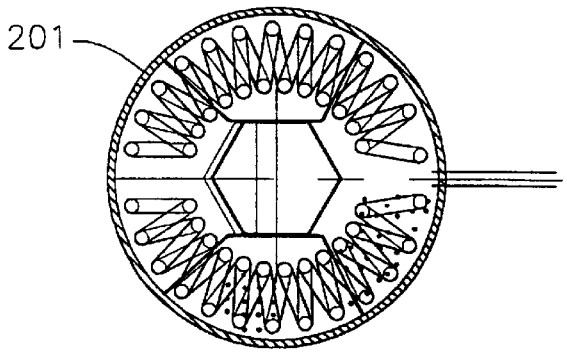
FIGS. 18 and 19 illustrate it in a containment.
Figure 18:
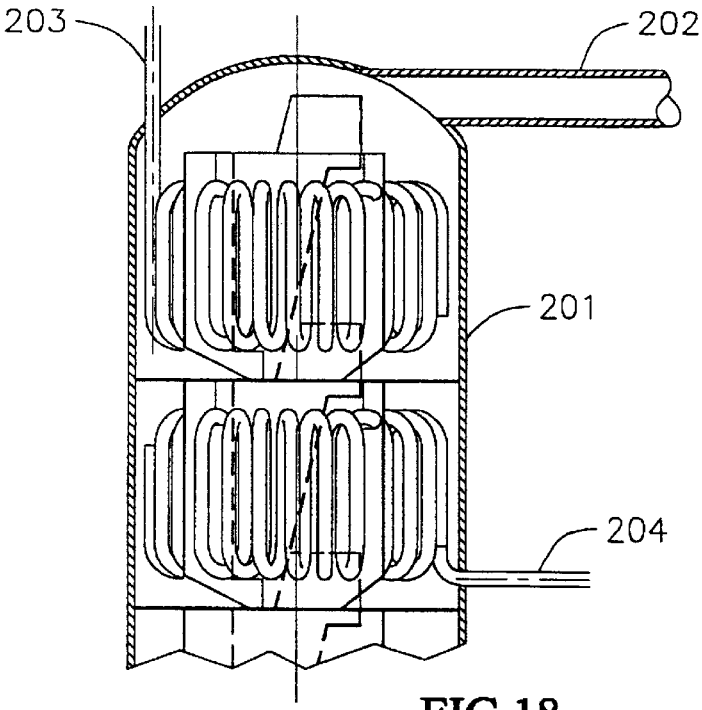

FIGS. 18 and 19 are side and top views respectively of the FIG. 13 configuration as it would be applied in a partial condenser. Containment 201 houses the contactor and upflowing vapor, which exits at 202. Coolant is supplied at 203 to the two conforming arrays, and withdrawn at 204. Central downcomer 205 allows condensate to pass from tray to tray.

Figure 20:
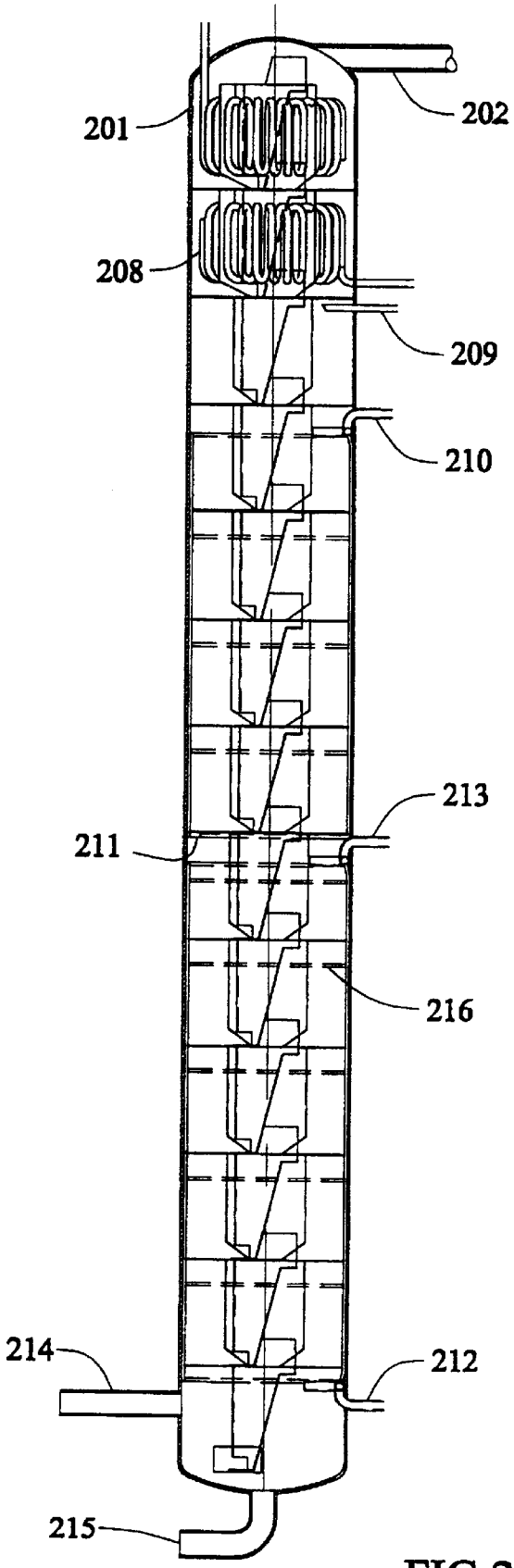
FIG. 20 illustrates an entire distillation column with the disclosed features and two types of heat exchange.

FIG. 20 illustrates an entire distillation column using diabatic same-horizontal-direction distillation with central downcomers and vapor block partitions. The top two trays are diabatic with conformal tubing arrays 208. The next tray is adiabatic, and accommodates column feed 209. The next four trays are diabatic with annular heat exchange. A second column feed is supplied to the annulus at 210, and is preheated to close to saturation while diabatically refluxing the column, and finally the liquid enters the trayed section at point 211. The bottom five trays are diabatically heated from an annular exchanger. A heating fluid such as bottom product liquid is supplied to the annulus at 212 and removed from the annulus at 213. Vapor from a reboiler is supplied at 214, and liquid is removed at 215. This particular column configuration finds use in $NH_3$—$H_2O$ absorption refrigeration units, among other applications.

Figure 21:
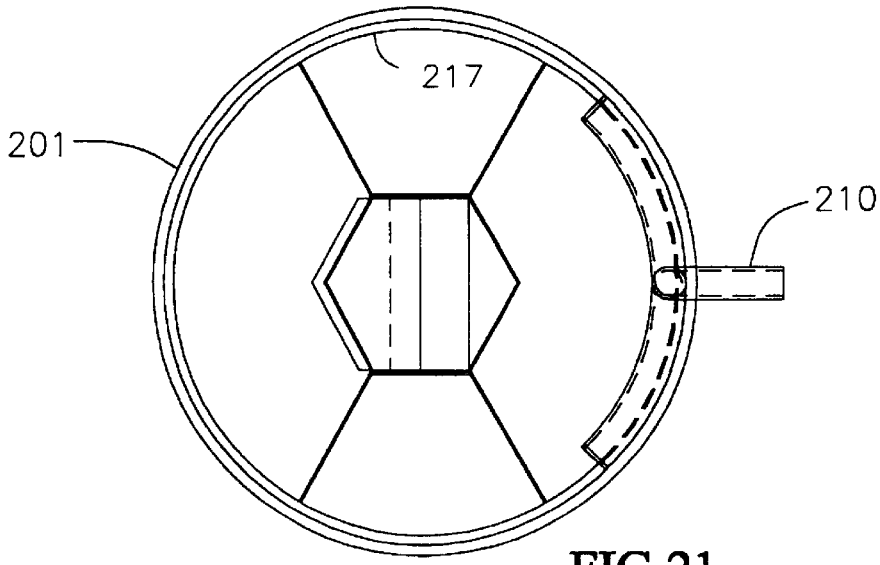
FIG. 21 is a cross-sectional view of tray with annular type of heat exchange.

FIG. 21 is a cross-section of the FIG. 20 column at a point where liquid enters the annulus, showing one possible configuration of the header. Guide bars 216 may be incorporated in the annular space of FIG. 20 to cause the heat transfer liquid to flow counter-currently to the temperature gradient on each tray.

When the annular heat exchange around the tray periphery is with a liquid heat transfer fluid, and particularly when it is with a column liquid which is at approximately the same pressure as the column itself, then it is very convenient to use a thin shroud 217 as the inner surface of the heat exchanger, and the containment pressure vessel 201 as the outer. However, when the liquid pressure is much higher than column pressure, and/or when the heat transfer fluid is a vapor such as hot combustion exhaust, then it is more convenient to use the containment itself as the inner surface. With hot exhaust, it is advantageous to apply heat transfer fin to the exterior surface of the containment.

The preceding central-downcomer same-direction horizontal liquid flow configurations both have bidirectional liquid flow around the peripheral contact zone. They differ in shape of central downcomer—square vs. hexagonal. It will be recognized that other downcomer cross-sections are possible, e.g., circular, polygonal, oval, or irregular. The tradeoffs involve tray-weir length, loss of active contactor area, and ease of construction. The hexagonal shape is a good general compromise on these factors.

In some circumstances it is desirable to have central-downcomer same-direction horizontal liquid flow with unidirectional liquid flow around the peripheral contact zone. For example, for small diameter columns, it may be difficult to achieve the desired number of horizontal stages on each tray with bi-directional flow. Also, for diabatic distillation, only a single conforming array coil is required on each tray for full counter-currency.

Figure 22:
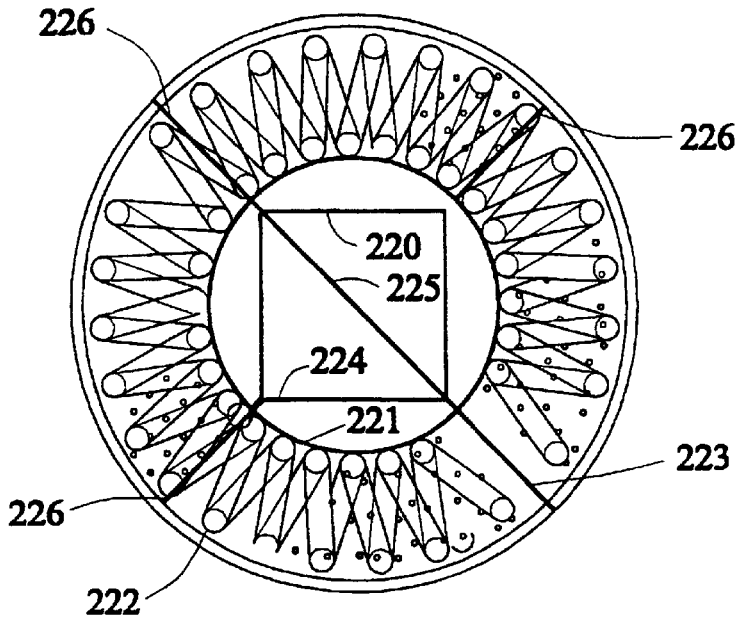
FIG. 22 is a cross-section of a tray with another new method of achieving center-to-center same-direction horizontal flow.
Figure 23:
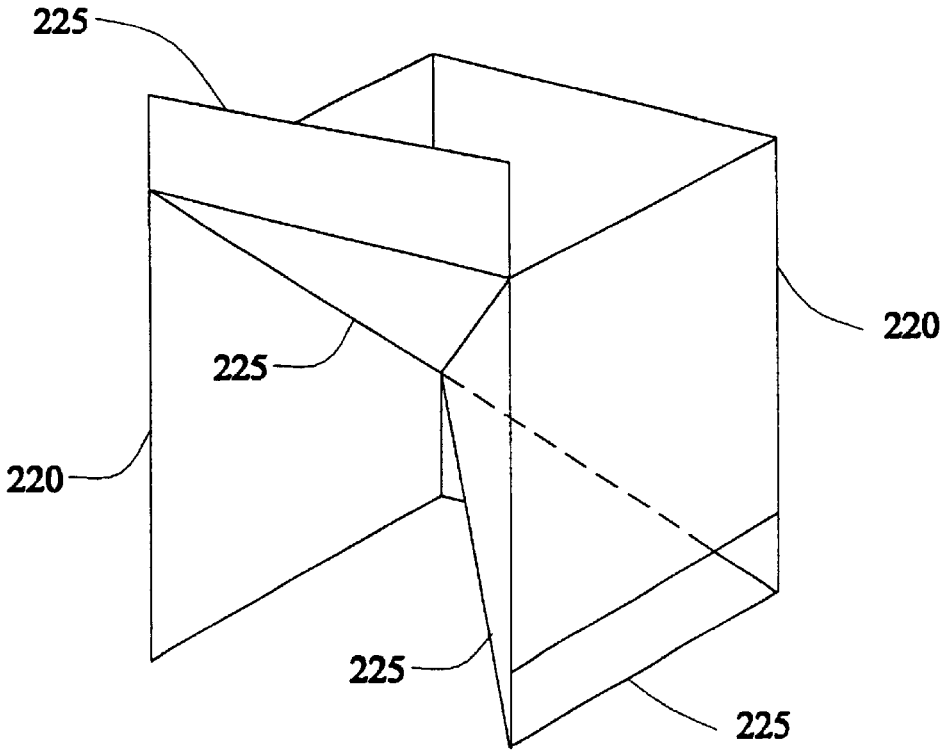
FIG. 23 is a detail of the associated tray downcomer.

FIG. 22 illustrates such a tray, with a square downcomer 220, a cylindrical channel weir 221, and a single conforming array heat exchange coil 222. This tray configuration is characterized by a liquid barrier 223 on each tray (also a thermal barrier), whereby liquid spills over tray weir 224 and then internal structure 225 directs the liquid down and over to the next face of the square, where it enters the contact zone of that tray. FIG. 23 illustrates details of the square downcomer 220 and the internal structure 225. Partitions 226 block vapor mixing and support the coil, plus help maintain tray spacing and rigidity.

As illustrated, it is possible to incorporate same-direction horizontal liquid flow and/or diabatic distillation without liquid recirculation. There are however two instances when it is especially advantageous to have liquid recirculation. One is when the higher vapor capacity possible with liquid recirculation is desired. The other is when high turndown is required—the liquid recirculation preserves a relatively fixed froth height, just above the channel weirs, where otherwise at high turndown much of the conforming array would be in vapor space. High turndown requirement would also be one of the indicators to use valves as vapor injectors vice perforations.

The above drawings are directed toward smaller size versions of this technology, but it will be recognized that it can be scaled to any size. Very large columns may have multiple heat exchange arrays on each tray, or other heat exchange geometries. Similarly, multiple central downcomers may be present vice only one. The upflow channels on each tray may have either catalyst or heat exchange present as disclosed, but can also have both present in various ways. One way would be vertical stacking, and another would be to coat the tubing with the catalyst.

The "quiescent" liquid level on each tray should be below the channel weir height and above the tray weir height for normal operation. Thus, the tray weir height must be below the channel weir height. Tray weir heights of 5 to 200 mm are contemplated.

"The heat exchange coils illustrated in FIGS. 12, 13, 18, 19, and 22 are known in the art as oval coils, i.e., coils wherein each successive 180° bend is in the same direction."

What is claimed is:

1. An apparatus for fractional distillation of a multi-component fluid comprised of:

a. vertically arranged trays;

b. sequentially arranged horizontal compartments on each tray;

c. each compartment adapted for at least one of:
   i. liquid recirculation; and
   ii. heat exchange with a heat transfer fluid;
d. means for vapor injection upwardly through each tray;
e. a downcomer for each tray which removes liquid from the same relative removal position on each tray, and delivers it to the same relative delivery position on each lower tray; and
f. partitions in the vapor space above the compartments of each tray which extend to the bottom of the next higher tray.

2. An apparatus for vapor-liquid contact comprised of:
a. multiple trays in vertical sequence;
b. vapor injection ports in each tray which allow passage of vapor from the adjacent lower tray;
c. a horizontal path for liquid across each tray; and a heat exchanger on at least some adjacent trays which is oriented counter-current to the tray temperature gradient.

3. The apparatus according to claim 2 additionally comprised of at least one partition in the vapor space of each tray which minimizes mixing of vapors of different concentrations.

4. The apparatus according to claim 3 wherein the liquid flow is the same direction on each tray.

5. The apparatus according to claim 2 wherein said heat exchanger is comprised of an oval coil of tubing.

6. The apparatus according to claim 2 wherein the liquid flowpath is across the tray.

7. The apparatus according to claim 2 wherein the liquid flowpath is unidirectional around the tray periphery.

8. The apparatus according to claim 2 wherein the liquid flowpath is bidirectional around the tray.

* * * * *